US006093452A

United States Patent [19]

Ishii et al.

[11] Patent Number: 6,093,452

[45] Date of Patent: Jul. 25, 2000

[54] CONTINUOUS HOT-DIP COATING METHOD AND APPARATUS THEREFOR

[75] Inventors: Toshio Ishii; Munehiro Ishioka; Akira Hiraya; Seishi Hatakeyama, all of Fukuyama; Nobuyuki Ishida, Yokohama; Teruhisa Kuwana, Yokohama; Kazumi Jiromaru, Yokohama; Toshihiko Ooi, Yokohama; Hideyuki Suzuki, Kawasaki; Shinichi Tomonaga, Fukuyama; Hitoshi Oishi, Yokohama; Kentaro Akashi; Takayuki Fukui, both of Fukuyama, all of Japan

[73] Assignee: NKK Corporation, Tokyo, Japan

[21] Appl. No.: 09/027,965

[22] Filed: Feb. 23, 1998

[30] Foreign Application Priority Data

| | | | |
|---|---|---|---|
| Feb. 25, 1997 | [JP] | Japan | 9-040932 |
| Sep. 29, 1997 | [JP] | Japan | 9-263165 |
| Sep. 29, 1997 | [JP] | Japan | 9-263166 |

[51] Int. Cl.[7] ..... B05D 1/18; B05D 3/02

[52] U.S. Cl. ..... 427/433; 427/319; 427/320; 427/321; 427/431; 427/436

[58] Field of Search ..... 427/319, 320, 427/321, 431, 433, 436

[56] References Cited

U.S. PATENT DOCUMENTS

| | | | |
|---|---|---|---|
| 4,107,357 | 8/1978 | Asakawa et al. | 427/300 |
| 4,439,212 | 3/1984 | Wang | 55/27 |
| 4,466,999 | 8/1984 | Leonard | 427/329 |
| 4,478,892 | 10/1984 | Amberson | 427/320 |
| 5,339,329 | 8/1994 | Flinchum et al. | 373/138 |

FOREIGN PATENT DOCUMENTS

| | | |
|---|---|---|
| 2-70049 | 3/1990 | Japan . |
| 4-120258 | 4/1992 | Japan . |
| 5-279827 | 10/1993 | Japan . |
| 6-49610 | 2/1994 | Japan . |

*Primary Examiner*—Roy V. King
*Assistant Examiner*—Michael Barr
*Attorney, Agent, or Firm*—Frishauf, Holtz, Goodman, Langer & Chick, P.C.

[57] ABSTRACT

A method for hot-dip coating a steel strip comprises: (a) continuously annealing the steel strip in an annealing furnace; (b) introducing the annealed steel strip into a molten metal coating bath through a snout; (c) dipping the annealed steel strip into the molten metal coating bath; (d) controlling a pressure inside of the snout; and (e) discharging a gas containing a metal vapor from the snout to outside of the snout. An apparatus comprises an annealing furnace, a coating pot, a control device for controlling a pressure inside the snout and a gas discharging device.

12 Claims, 11 Drawing Sheets

PRESSURE DIFFERENCE < 5 mm $H_2O$

PRESSURE DIFFERENCE 5 TO 20 mm $H_2O$

PRESSURE DIFFERENCE $\geqq$ 20 mm $H_2O$

CONTINUOUS HOT-DIP COATING METHOD AND APPARATUS THEREFOR

BACKGROUND OF THE INVENTION

1. Field of the Invention

The present invention relates to a method for coating a steel strip and an apparatus therefor.

2. Description of the Related Arts

FIG. 5 shows a conventional apparatus for continuous hot-dip coating. The method for hot-dip coating using the apparatus is described below.

A steel strip S is continuously annealed in an annealing furnace while cleaning the surface thereof at a time, then the steel strip S is passed through a coating pot 4 to apply coating thereto. Since the annealing step is normally conducted in a reducing atmosphere, a snout 3 which has a rectangular cross section is located between the annealing furnace and the coating pot 4 to keep the reducing atmosphere. Thus the steel strip S passes through the snout 3 and enters into the coating pot 4 which contains a molten metal to perform the specified metal coating without exposing the steel strip to environmental air. The running direction of the coated steel strip S is changed by a sink roll 6 in the coating pot 4 to rise vertically to be taken out from the coating pot 4. The coating thickness of the steel strip S which was taken out from the coating pot 4 is adjusted to a predetermined level using a gas-wiping nozzle 7, then the steel strip S is cooled by a cooling unit (not shown), further is sent to a succeeding step for undergoing temper rolling or other treatment, at need.

The atmospheric gas is supplied into the furnace through a cooling zone 1 at the exit side of the annealing furnace or through the snout 3, and flows toward the inlet side of the annealing furnace, which flowing direction is opposite to the running direction of the steel strip S. Since the inside of the snout is kept in a reducing atmosphere, an oxide film is hardly formed on the surface L of, the molten metal bath in the snout. As a result, the molten metal is exposed directly onto the bath surface, which results in the evaporation of the molten metal to a saturated vapor pressure at the temperature of the molten metal bath. The vapor of evaporated molten metal reacts with a slight amount of oxygen which exists in the reducing atmosphere within the snout and within the annealing furnace to yield an oxide.

Even when the metal vapor is not converted to an oxide, if the vapor pressure of the evaporated molten metal exceeds the saturated vapor pressure thereof in the evaporated zone, the evaporated molten metal returns to the metallic state because the evaporated molten metal cannot sustain its vapor phase. Particularly when the temperature at the cooling zone in the annealing furnace and at the internal face of the snout is at or below the saturation temperature at the vapor pressure of the evaporated molten metal, the metal vapor condenses to become metal powder, which metal powder then deposits onto the inner face of the furnace and of the snout.

If the oxide and deposit directly attach to the cleaned steel strip during the treatment, irregular coating or absence of coating may appear, which induces quality defects caused by dross deposition.

If the oxide drops onto the surface L of the molten metal bath in the snout, the oxide does not dissolve in the molten metal bath M because the melting temperature of the oxide is higher than the temperature of the molten metal. When the deposit drops onto the surface L of the molten metal bath in the snout, the deposit is remelted if it is the same metal with the molten metal. In most cases, however, the deposit contains impurities so that it does not dissolve in the molten metal bath M.

The oxide and deposit which do not dissolve after dropping onto the molten metal float on the surface L of the molten metal bath in the snout, then flow along the stream of the molten metal bath M accompanied with the steel strip entering the coating bath, thus migrate toward the steel strip and finally attach thereto. In that case, also, the deposit acts as an interference cause against a coating action, so the coating thickness becomes thin and an irregular coating appears, which induces quality defects caused by dross deposition.

Various methods have been introduced to prevent the generation of quality defects caused by dross deposition in the snout. These proposed methods are roughly classified into two groups.

The first group is a method to remove impurities which dropped onto the surface of bath in the snout to outside of the snout. For example, JP-A-2-70049 (the term "JP-A" referred to herein signifies "unexamined Japanese patent publication"), JP-A-4-120258, and JPA-5-279827, (hereinafter these patent publications are referred to simply as "the Prior Art 1") disclose a method to prevent the occurrence of quality defects caused by dross deposition by continuously guiding the molten metal from inside of the snout to outside thereof, thus removing impurities dropped in the snout and simultaneously maintaining fresh surface of the molten metal bath. According to the Prior Art 1, a pump is installed either in or above the molten metal bath to induce the molten metal flow.

The second group is a method to reduce the occurrence of quality defects by suppressing the generation of oxide in the snout. For example, JP-A-6-49610, (hereinafter the patent publication is referred to simply as "the Prior Art 2"), discloses a method to suppress the generation of dross on the surface of molten metal bath in the snout by locating a seal at an upper portion of the snout while contacting or non-contacting the steel strip, and by injecting a gas having a stronger reducing performance than that of the reducing atmosphere in the annealing furnace into the snout between the seal and the molten metal bath.

Prior Art 1 uses a pump for transferring the molten metal. For the case that the molten metal is molten zinc, for instance, the molten zinc severely erodes other metals so that the life of the pump is significantly short, or about 3 months at the longest. Therefore, Prior Art 1 has a problem of durability of facilities. Furthermore, Prior Art 1 does not remove metal vapor from the system. Thus Prior Art 1 provides no full scale problem solving.

According to the method described in Prior Art 2, the surface of the molten metal bath is cleaned to reduce the oxide film formation. As a result, evaporation of metal from the surface of molten metal bath is further enhanced. The reducing gas containing evaporated metal passes through the seal in the snout, flows from the snout into the annealing furnace, then condenses in the snout and in the annealing furnace, or reacts with a slight amount of oxygen in the furnace to become an oxide, which forms deposit in the snout and the annealing furnace. As described above, that type of deposit directly adheres to the steel strip, or floats on the surface of molten metal bath in the snout, and accumulates with operation time to induce quality defects caused by dross deposition. Therefore, Prior Art 2 needs to have an additional means to solve the surface defect problem.

Consequently, Prior Art 2 is insufficient as a preventive method against quality defects caused by dross deposition.

That is, there has not been developed a molten metal coating method that has a strong effect of preventing quality defects caused by dross deposition in the snout, or an apparatus therefor having excellent durability.

SUMMARY OF THE INVENTION

It is an object of the present invention to provide a molten metal coating method having an excellent effect of the preventing occurrence of quality defects caused by dross deposition in a snout and to provide an apparatus therefor.

First, the present invention provides a method for hot-dip coating a steel strip comprising the steps of:

(a) continuously annealing the steel strip in an annealing furnace having an entrance side and an exit side;

(b) introducing the annealed steel strip into a molten metal coating bath through a snout, one end of the snout being connected to the annealing furnace and the other end being immersed into the molten metal coating bath;

(c) dipping the annealed steel strip into the molten metal coating bath;

(d) maintaining a pressure inside of the snout by sealing between the annealing furnace and the snout so that the pressure is a barometric pressure or more and lower than an internal pressure of the annealing furnace; and (e) discharging a gas containing a metal vapor from the snout to outside of the snout, the metal vapor being evaporated from the molten metal coating bath in the snout.

It is preferable that the pressure inside of the snout is lower by 5 $mmH_2O$ or more than the internal pressure of the annealing furnace. It is more preferable the pressure inside of the snout is lower by 5–10 $mmH_2O$ than the internal pressure of the annealing furnace. By maintaining the pressure inside of the snout to a level lower by 5 $mmH_2O$ or more than the internal pressure of the annealing furnace, the gas flows from the annealing furnace toward the snout, which prevents the gas containing metal vapor evaporated from the molten metal bath from the snout toward the annealing furnace. Accordingly, no deposition of oxide and condensate of metal vapor coming from the molten metal bath occurs inside of the annealing furnace.

By maintaining the pressure inside of the snout to barometric pressure or more, the invasion of oxygen from outside of the snout into the snout is prevented. In addition, the gas is discharged from the snout to outside of the snout, so the gas containing metal vapor evaporated from the molten metal bath is promptly discharged to outside of the snout. As a result, deposition of oxide and condensate of metal vapor evaporated from the molten metal bath inside of the snout is prevented.

Through the above-described functions, the occurrence of quality defects caused by dross deposit inside of the snout is prevented.

It is desirable that above mentioned method further comprises the steps of:

removing the metal vapor from gas discharged from the snout to clean the discharged gas; and returning the cleaned gas into the annealing furnace. Secondly, the present invention provides an apparatus for hotdip coating a steel strip, comprising:

(a) an annealing furnace for continuously annealing the steel strip, the annealing furnace having an entrance side and an exit side;

(b) a coating pot having a molten metal coating bath for coating the annealed steel strip;

(c) a snout through which the annealed steel strip is introduced into the molten metal coating bath, one end of the snout being connected to the annealing furnace and the other end being immersed into the molten metal coating bath;

(d) a seal device for sealing between the annealing furnace and the snout, the seal device being arranged at the exit side of the annealing furnace; and (e) a discharge means for discharging a gas containing a metal vapor from the snout to outside of the snout, the metal vapor being evaporated from the molten metal coating bath in the snout.

The seal device preferably comprises an upper seal and a lower seal, the upper seal being arranged at an upper part of a deflector roll and the lower seal being arranged at a lower part of the deflector roll.

It is preferable that the apparatus for hot-dip coating further comprises: means for removing the metal vapor from gas discharged from the snout to clean the discharged gas; and means for returning the cleaned gas into the annealing furnace.

Thirdly, the present invention provides a method for hot-dip coating a steel strip comprising the steps of:

(a) continuously annealing the steel strip in an annealing furnace;

(b) introducing the annealed steel strip into a molten metal coating bath through a snout, one end of the snout being connected to the annealing furnace and the other end being immersed into the molten metal coating bath;

(c) dipping the annealed steel strip into the molten metal coating bath;

(d) separating the molten metal coating bath from the annealing furnace by using a seal device having a seal portion inside of the snout; and (e) discharging a gas in the snout between the sealing device and the molten metal coating bath through pipes having exhaust ports which are arranged at the snout near both edges in width of the steel strip.

In above-mentioned method, the molten metal coating bath is preferably a molten Al—Zn alloy coating bath.

It is desirable that the step (e) of discharging comprises discharging the gas in the snout between the sealing device and the molten metal coating bath so that a gas flow in the sealing portion have a flowing rate of 1 m/sec. or more from the annealing furnace to the molten metal coating bath and a gas pressure in the snout between the coating bath and the sealing device is higher than a pressure outside of the snout.

It is preferable that the method for hot-dip coating further comprises the steps of:

removing the metal vapor from gas discharged from the snout to clean the discharged gas; and returning the cleaned gas into the annealing furnace.

Fourthly, the present invention provides an apparatus for hot-dip coating a steel strip, comprising:

(a) an annealing furnace for continuously annealing the steel strip;

(b) a coating pot having a molten metal coating bath for coating the annealed steel strip;

(c) a snout through which the annealed steel strip is introduced into the molten metal coating bath, one end of the snout being connected to the annealing furnace and the other end being immersed into the molten metal coating bath;

(d) a seal device having a seal portion inside of the snout for separating the molten metal coating bath from the annealing furnace; and (e) a discharge means for discharging a gas in the snout between the sealing device and the molten metal coating bath.

Preferably, the apparatus further comprises a control means for controlling a gas flow rate in the sealing portion and a gas pressure in the snout between the coating bath and the sealing device, thereby the gas flow rate being controlled to be a predetermined gas flow rate or more and the gas pressure being controlled to be higher than a pressure outside of the snout.

It is preferable that the apparatus further comprises: means for removing the metal vapor from gas discharged from the snout to clean the discharged gas; and means for returning the cleaned gas into the annealing furnace.

Fifthly, the present invention provide a method for hot-dip coating a steel strip comprising the steps of:

(a) continuously annealing the steel strip in an annealing furnace;

(b) introducing the annealed steel strip into a molten metal coating bath through a snout, one end of the snout being connected to the annealing furnace and the other end being immersed into the molten metal coating bath;

(c) dipping the annealed steel strip into the molten metal coating bath;

(d) discharging a gas containing a metal vapor generated from the molten metal coating bath in the snout through an exhaust opening arranged at the snout to prevent the metal vapor from entering the annealing furnace;

(e) introducing the discharged gas into an ash recovery tank while maintaining a temperature of the discharged gas to a melting point of zinc or more;

(f) cooling the introduced gas below the melting point of zinc in the ash recovery tank to convert the metal vapor to ash and remove the ash from the gas; and (g) venting the gas from the ash recovery tank through a vent pipe to the air.

The exhaust opening is preferably arranged at 2 meters or less above a surface of the molten metal coating bath. It is desirable that the method further comprises the step of controlling a flow rate of the vented gas through the vent pipe.

Sixthly, the present invention provides an apparatus for hot-dip coating a steel strip, comprising:

(a) an annealing furnace for continuously annealing the steel strip;

(b) a coating pot having a molten metal coating bath for coating the annealed steel strip;

(c) a snout through which the annealed steel strip is introduced into the molten metal coating bath, one end of the snout being connected to the annealing furnace and the other end being immersed into the molten metal coating bath;

(d) an exhaust opening, which is arranged at the snout, for discharging a gas containing a metal vapor generated from the molten metal coating bath in the snout;

(e) an ash recovery tank in which the gas is cooled below a melting point of zinc to convert the metal vapor to ash and remove the metal vapor from the gas;

(f) a pipe for introducing the discharged gas from the exhaust opening into an ash recovery tank while maintaining a temperature of the discharged gas to the melting point of zinc or more; and (g) a vent pipe for venting the gas from the ash recovery tank to the air.

It is preferable that the apparatus further comprises a control means for controlling a flow rate of the vented gas, the control means being arranged at the vent pipe.

DESCRIPTION OF THE EMBODIMENT

Embodiment 1

Figure 1:
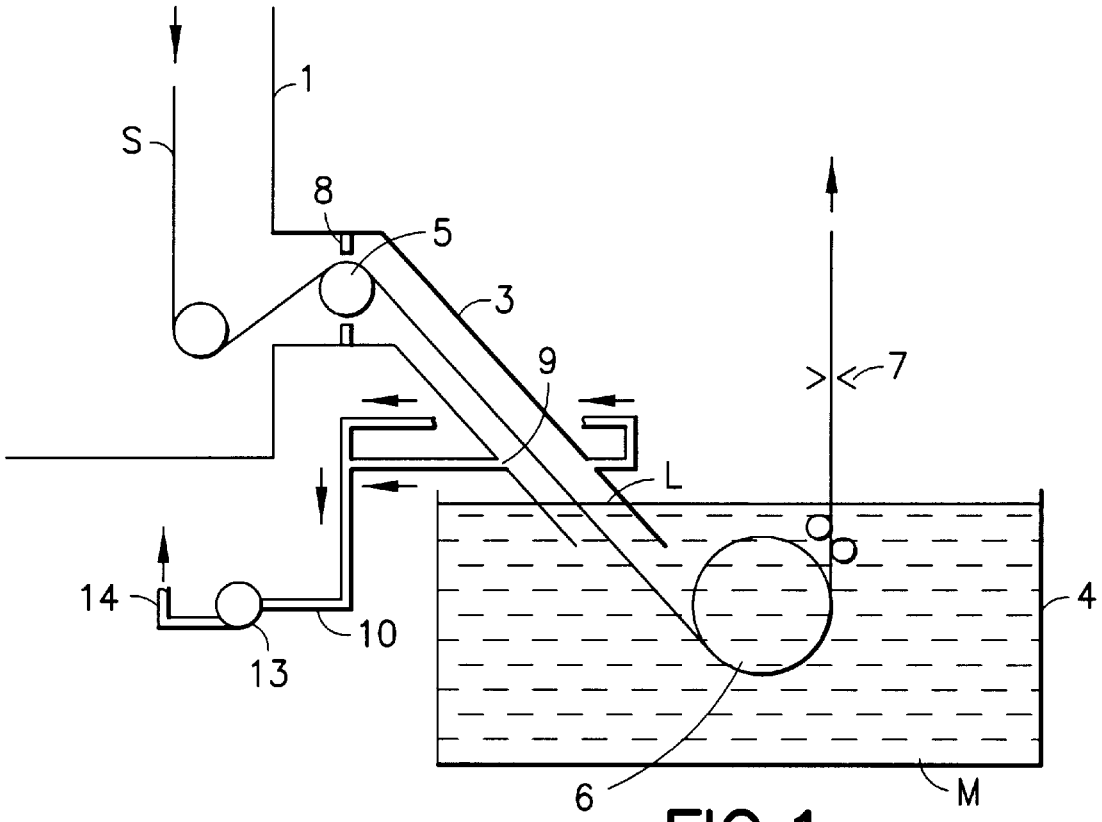
FIG. 1 is a schematic view showing an apparatus for carrying out the continuous molten metal coating according to the Embodiment 1.

Referring to FIG. 1, a deflector roll 5 is located at exit of a cooling zone 1 at a rear portion of the annealing furnace. A seal device 8 is located in the deflector roll section. A blower 13 is used to discharge the gas. The blower 13 discharges the gas from a gas discharge opening 9 at the lower part of a snout 3 to outside of the snout via gas discharge pipes 10, 14.

Figure 2:
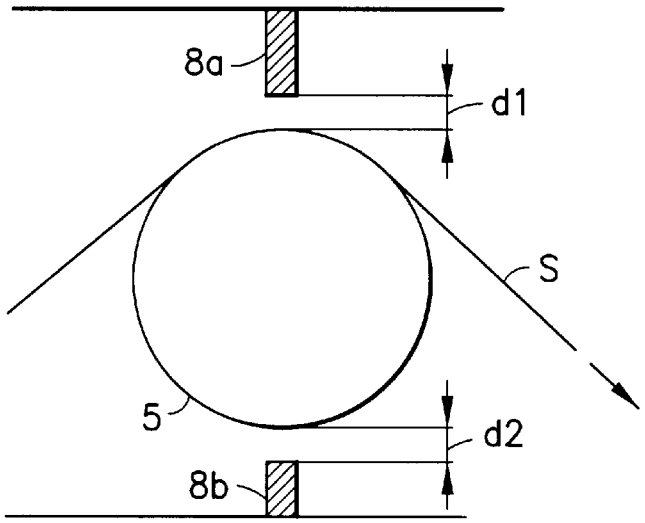
FIG. 2 is a view showing a seal device used in a continuous molten metal coating apparatus according to the Embodiment 1.

FIG. 2 shows the detail of the seal device 8. Each of the seals 8*a*, 8*b* is located at upper part and lower part of the deflector roll 5, respectively. The sealing performance is improved by minimizing the distance d1 between the top seal 8*a* and the deflector roll 5, and by minimizing the distance d2 between the bottom seal 8*b* and the deflector roll 5. In concrete terms, the distance d1 is kept to 10 mm or more to prevent contact with the steel strip during the period of traveling of a welded-section or under a condition of incorrect steel strip shape, and the distance d2 is kept to 10 mm or less because no contacting object exists beneath the roll.

For attaining excellent sealing effect with a small amount of gas discharge, and for preventing the contact of the seals with the steel strip and the roll, it is preferable to maintain the distance d1 to an approximate range of from 10 to 40 mm, and the distance d2 to an approximate range of from 5 to 10 mm.

The reason to locate the seal device at the deflector roll portion is that the steel strip runs in the deflector roll portion while winding around the deflector roll so that the position fluctuation of the steel strip caused from fluttering and incorrect shape thereof occurs less, thus the seal distance is further shortened to improve the sealing effect. If, however, the position fluctuation is less, the seal may be done at any portion other than the deflector roll portion.

When the gas is discharged from the discharge opening 9 at the lower part of the snout using the blower 13, the sealing effect of the seal device induces a difference in internal pressure between the cooling zone 1 and the snout 3. In that case, when the amount of discharged gas is adjusted to maintain the pressure inside of the snout 3 to a level lower by 5 $mmH_2O$ or more than the pressure inside of the cooling zone 1, the gas enters from the cooling zone 1 to the snout 3, while the gas does not flow from the snout 3 to the cooling zone 1. Thus, in the cooling zone 1, the generation of deposit caused from an oxide and a condensate of metal vapor evaporated from the molten metal bath is prevented.

Figure 3A:
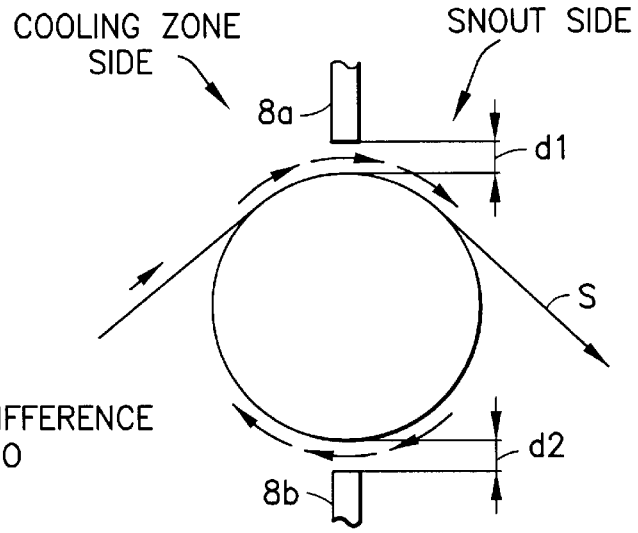
FIG. 3*a* to FIG. 3*c* are illustrations showing the gas flow state in a seal device used in a continuous molten metal coating apparatus according to the present invention.
Figure 3B:
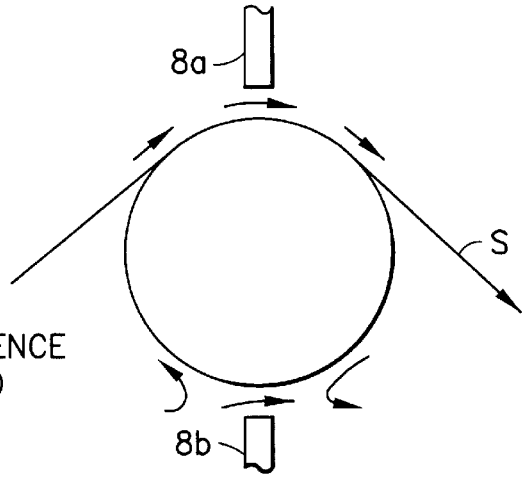
Figure 3C:
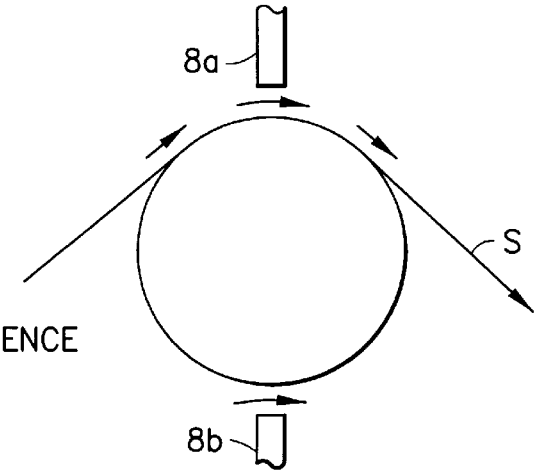

The above-described functions were validated also by a numerical simulation. FIG. 3 shows schematic drawings of the seal device used in the numerical simulation. The simulation was carried out under the conditions of: 30 mm of top seal distance d1; 10 mm of bottom seal distance d2; and 120 m per minute of steel strip running speed.

When the internal pressure difference between the cooling zone and the snout is less than 5 $mmH_2O$, the gas flow is governed by a flow accompanied with the rotating roll, which is illustrated in FIG. 3(*a*). At above the roll, the gas flows from the cooling zone toward the snout. At below the roll, however, the gas passes through a gap at the bottom seal and enters from the snout to the cooling zone. If that type of gas flow exists, it is unable to prevent the occurrence of deposit by an oxide and a condensate of metal vapor evaporated from the molten metal bath in the cooling zone.

When the internal pressure of the snout becomes lower by 5 $mmH_2O$ or more than the internal pressure of the cooling zone, the gas flow is governed rather by the flow induced from the pressure difference than by the flow accompanied with the rotating roll, which is illustrated in FIG. 3(*b*). Accordingly, at below the roll, the gas passes through a gap at the bottom seal and enters from the cooling zone to the snout. At above the roll, the gas also flows from the cooling zone into the snout.

When the internal pressure of the snout becomes lower by 20 $mmH_2O$ or more than the internal pressure of the cooling zone, the gas flow is completely governed by the flow induced from the pressure difference, which is illustrated in FIG. 3(*c*). In that case, however, the gas flow rate entering from the cooling zone into the snout becomes too large, and results in an excessive load to the gas discharge unit. Therefore, it is preferable that the pressure difference between the cooling zone 1 and the snout 3 is kept in an approximate range of from 5 to 10 $mmH_2O$.

By maintaining the internal pressure of the snout 3 to barometric pressure or more, the invasion of oxygen from outside of the snout into the snout is prevented. By locating the gas discharge opening 9 at lower part of the snout 3, the evaporated metal is immediately discharged to outside of the snout, thus eliminating the retaining of a large amount of metal vapor in the snout 3. Therefore, the generation of a deposit is caused by oxidation of metal vapor evaporated from the molten metal bath in the snout and by condensation of the vapor at a low temperature zone.

The apparatus shown in FIG. 1 was used to conduct hot-dip galvanizing under the conditions of: internal pressure of the cooling zone 1 at +20 $mmH_2O$ against barometric pressure; +15 $mmH_2O$ of internal pressure of the snout; discharge of gas from the lower part of the snout. The result was a significant decrease of frequency of cleaning of a deposit of an oxide and a condensate of metal vapor, which deposit appears in the cooling zone, compared with a conventional 12 hours of cleaning work once every two weeks. In addition, the occurrence of quality defects caused by dross deposition in the snout was completely vanished.

The apparatus above-described uses the blower 13 for discharging gas. If, however, the pressure difference between the snout and the annealing furnace is able to bring to 5 $mmH_2O$ or more while maintaining the internal pressure of snout at or above the barometric pressure only by the gas discharge from the gas discharge opening 9 of the snout or by the draft of the gas discharge pipe 10, then the blower 13 may not be applied and a valve may be installed at the exit of gas discharge opening 9 or on the gas discharge pipe 10 to regulate the necessary pressure by adjusting the opening of the valve.

If the above-described pressure difference comes below 5 $mmH_2O$, then the effect of the present invention decreases.

Nevertheless, the effect of the present invention is performed to some extent even in that situation if only a positive pressure difference is maintained.

Figure 4:
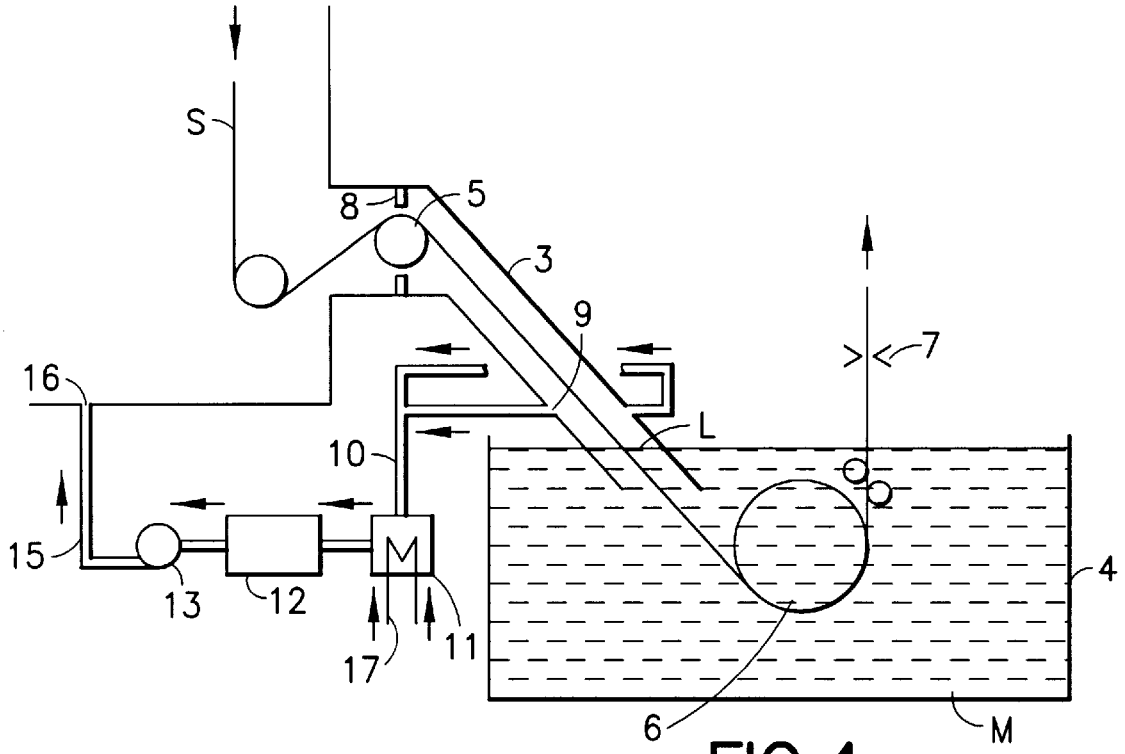
FIG. 4 is another schematic view showing another apparatus for carrying out the continuous molten metal coating according to the Embodiment 1.
Figure 5:
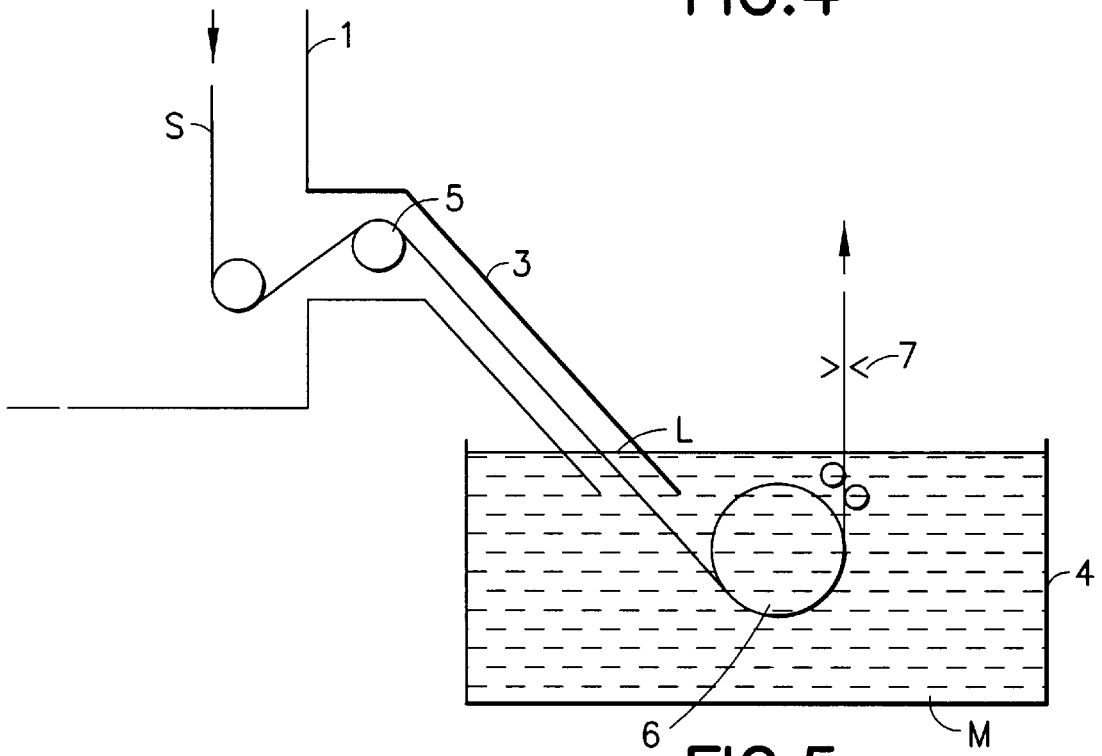
FIG.5 PRIOR ART
FIG. 5 is a schematic view showing a conventional apparatus for carrying out the continuous molten metal coating.

The following is the description on the modes of the present invention referring to FIG. 4. The apparatus shown in FIG. 4 has the configuration given in FIG. 1, and further comprises a cooling unit 11 that cools the gas discharged from the lower part of the snout, a filter 12 that removes condensed metal and metal oxide existing in the cooled gas, and a gas return pipe 15 that feeds the cleaned gas to the cooling zone 1.

The cooling unit 11 may be the one provided with a cooling tube 17. It is preferable that the cooling unit 11 is able to cool the gas to the solidification temperature of the metal or below to condense the metal vapor in the gas. The filter 12 may be a heat-resistant bag filter or the like.

In a similar method described in the modes of the present invention, the apparatus described above discharges the gas from the gas discharge opening 9 at the lower part of the snout, cools the discharged gas in the cooling unit 11 to condense the metal vapor in the discharged gas, thus removing the metal condensed from the gas and the oxide in the filter 12. Then, the cleaned gas is charged into the cooling zone 1 from the gas charge opening 16 via the gas return pipe 15.

Since the present invention recirculates the gas, the use amount of the atmospheric gas is further reduced.

According to the present invention, generation of deposit in the cooling zone of annealing furnace and in the snout caused from an oxide and a condensate of metal vapor evaporated from the molten metal bath is prevented, so the occurrence of quality defects caused by the dross deposition inside of the snout is significantly reduced. In addition, according to the present invention, the frequency of removal work of a deposit caused by an oxide and a condensate of metal vapor evaporated from the molten metal bath in the cooling zone is significantly reduced.

Since the apparatus according to the present invention has an excellent durability, the present invention also contributes to reduce the maintenance load.

Furthermore, cleaning of discharged gas decreases the use amount of atmospheric gas.

Embodiment 2

For preventing the quality defects caused by evaporation of the molten metal in the coating of Al—Zn alloy, it is useful to expel the evaporated metal vapor outside of a facility. For further enhancing the expelling effect, it has been found that it is significant to control appropriately a flow of an atmospheric gas in the snout. The present invention is based on such a finding and is characterized as follows.

A continuously coating method of a molten Al—Zn alloy, comprises continuously passing a steel strip into a coating bath where Al—Zn alloy is molten so as to carry out the coating of Al—Zn on the steel strip by providing a sealing device between the coating bath and a pre-processing annealing furnace or a cooling furnace, and expelling a gas within a facility from vicinities of both edges in width of the steel strip between said coating bath and said sealing device.

The sealing device is provided between the coating bath and the annealing furnace or the cooling furnace, and the gas is exhausted from the vicinities of both edges in the width of the steel strip between the coating bath and the sealing device, whereby the gas flows downward between the sealing device and the coating bath, and the vapor of the molten metal evaporating from the coating bath is rapidly exhausted from the exhausting port to the outside of the snout.

It is possible to greatly decrease the oxides or the deposits within the snout at the downstream of the sealing device, so that occurrences of defects in products caused thereby may be avoided.

The gas flow in a sealing portion of the sealing device is controlled to have a flowing rate of 1 m/sec or more from an upstream to a downstream of the sealing device, and is controlled to expel the gas within the facility such that a gas pressure between the coating bath and the sealing device to be not less than a pressure outside of the facility.

The vapor of the molten metal contained in the exhausted gas is expelled, and the gas which has been expelled of the vapor of the molten metal is circulated into the annealing furnace or the cooling furnace, thereby enabling circulation of the atmospheric gas, so that the amount of the atmospheric gas can be decreased.

The metal powders (ashes) adhered to the interior of a pipe exhausting the gas outside of the facility is removed by blowing the gas at high speed into the pipe in an opposite direction of said gas flowing direction.

Figure 6:
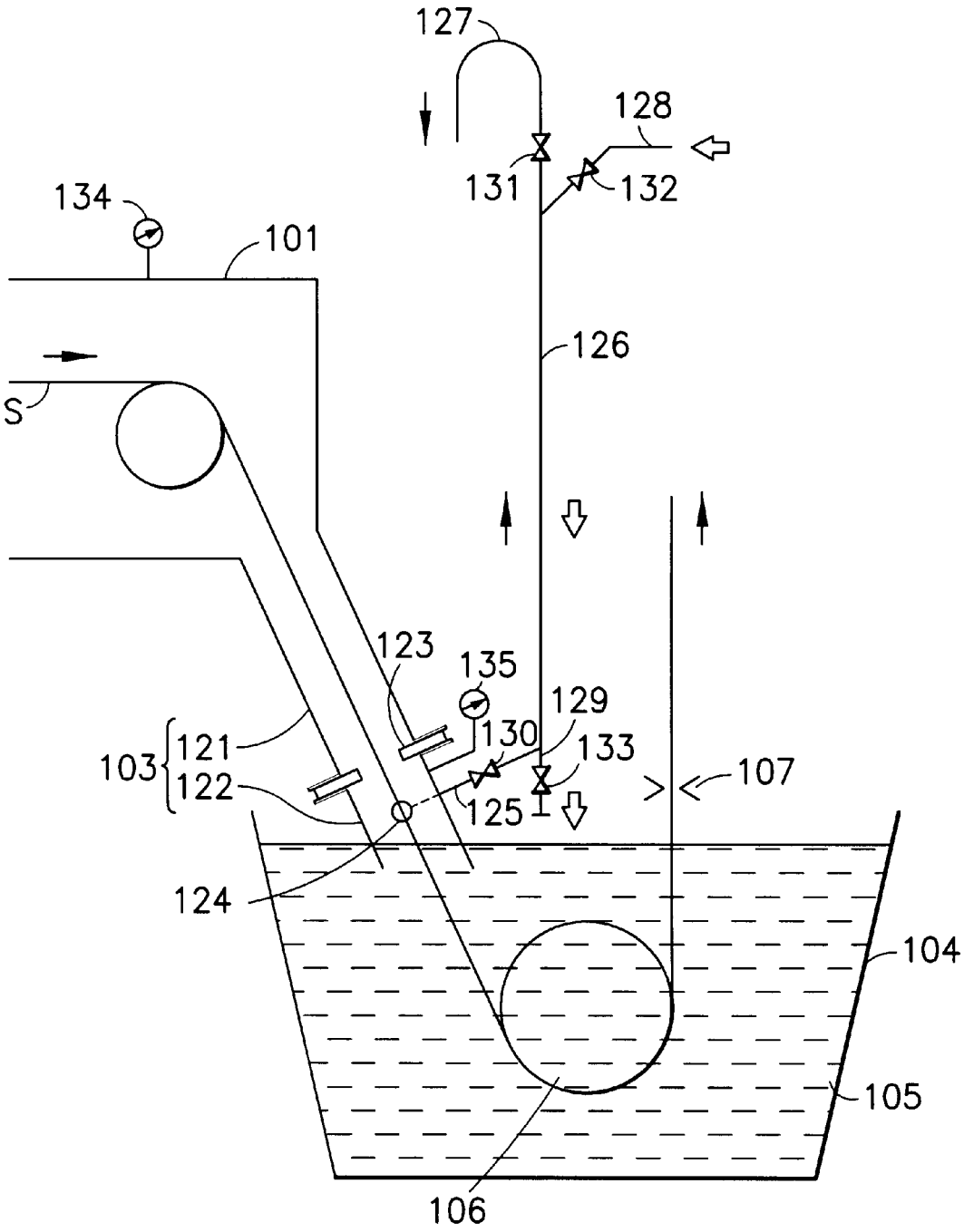
FIG. 6 is a schematic view showing a coating apparatus according to the Embodiment 2.

The invention will be explained with reference to the attached drawings. FIG. 6 is a schematic view showing a cross section of the coating apparatus for explaining the embodiment of the invention. In FIG. 6, a numeral 101 is a cooling furnace, 103 is a snout, 104 is a coating pot, 105 is a coating bath where Al—Zn alloy is molten, 106 is a sink roll, 107 is a gas wiping nozzle, 123 is a sealing device, 124 is an exhausting port, 128 is a high speed nitrogen gas supplying pipe, and 134, 135 are pressure gauges.

The snout 103 comprises a member 121 disposed at a rear of the preprocessing cooling furnace 101 and a member 122 immersed in the coating bath 105, the member 122 being corrosion resistant against the molten metal. Since the member 122 is not durable for continuous use for a long period, it is periodically exchanged after predetermined usage, however the member 121 is not periodically exchanged. The distance for the strip running of the member 122 is smaller than that of the member 121.

The sealing device 123 is arranged at a flange between the members 121 and 122, and is formed with a heat resistant glass fiber paper. The sealing device 123 is defined with an opening for the steel strip to run. An opening in the direction of the steel width is designed for adding a maximum meandering width to a maximum strip passing width of the strip. It is inherently preferable that a distance between the strip surface and the sealing device is zero, however since contact with to the strip is not preferable respect of the product quality, in the present case, the distance is separated 500 mm from the strip with respect to a standard strip passing position, taking into consideration a maximum catenary of the strip depending upon thickness and tension of the steel strip.

Since it is possible to prevent that the vapor of the evaporated molten metal from dispersing over the sealing device 123 to the side of the upstream member 121, oxides or adhered substances (ashes) do not occur around the member 121, and even if ashes adhere to the member 122, they may be removed when periodically exchanging this member.

In FIG. 6, the sealing device 123 is of a sheet shape, a sealing device may be of course such a type as of a sealing roll provided with a drive device or measuring positions of the strip and following them.

The exhausting ports 124 are two in total at both sides outside of the member 122. The gas exhausted from the exhausting port 124 is discharged into the atmosphere via pipes 126, 127.

Figure 7A:
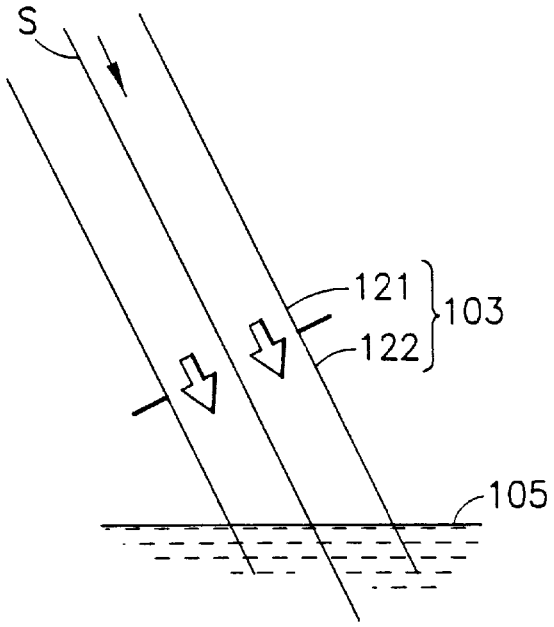
FIG.7a PRIOR ART
FIG. 7*a* and FIG. 7*b* are views for explaining gas flowing in the snout in a prior art.
Figure 8A:
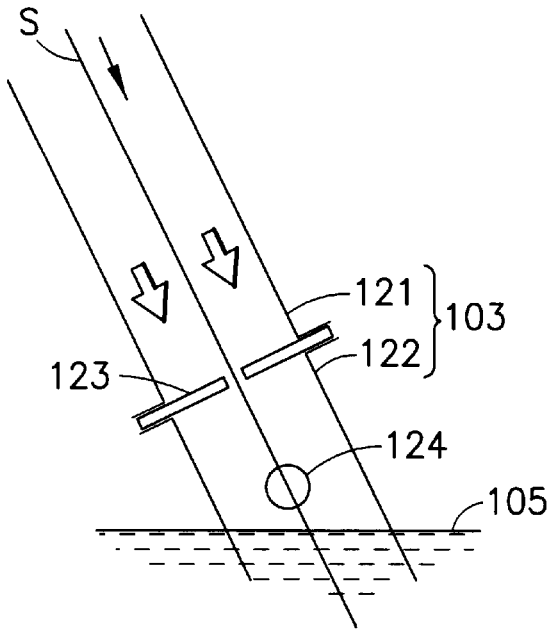
FIG. 8*a* and FIG. 8*b* are views for explaining gas flowing in the snout in the Embodiment 2.

The sealing effect and the exhausting effect of the above said device were confirmed through numerical simulations. The confirmed results will be explained with schematic views of FIGS. 7*a* and 8*a*. FIG. 7*a* shows the gas flowing condition of a line speed of 120 m per minute without the sealing device and the exhausting port, and FIG. 8*a* shows the gas flowing condition of the line speed 120 m per minute with the sealing device and the exhausting port. The gas flowing directions are shown with white arrows. In FIG. 8*a*, the exhausting ports 124 are provided at both sides at the edges of the steel S of the member 122. The gas flowing rate at the sealing portion of the sealing device 123 is 1 m/sec, and the gas pressure between the sealing device 123 and the coating bath 105 is higher than that of outside of the facility.

Figure 7B:
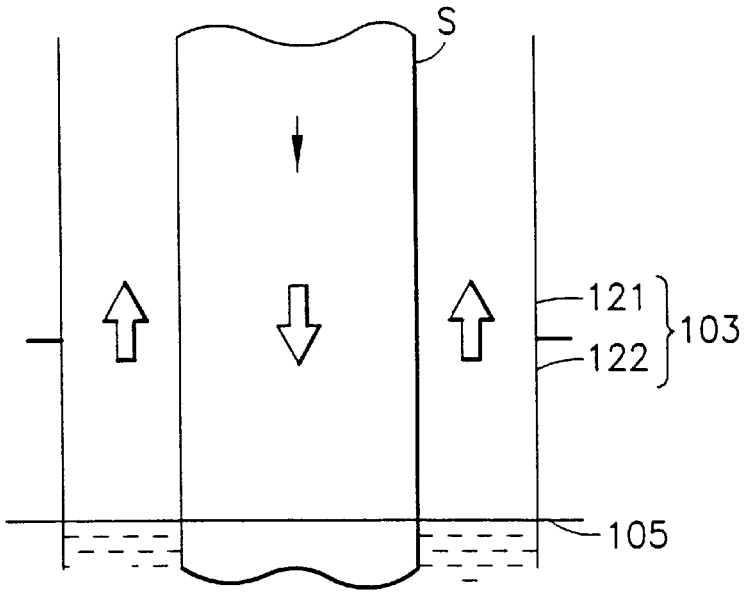
FIG.7b PRIOR ART

In a case where there is neither provided the sealing device nor the exhausting port, the gas is, as seen in FIG. 7*b*, agitated by an accompanying flow of the steel strip S within the snout 103. In this case, the vapor of the evaporated molten metal from the coating bath 105 is carried by said accompanying flow to the upstream of the snout 103, and becomes ashes in the snout, cooling furnace and annealing furnace.

Figure 8B:
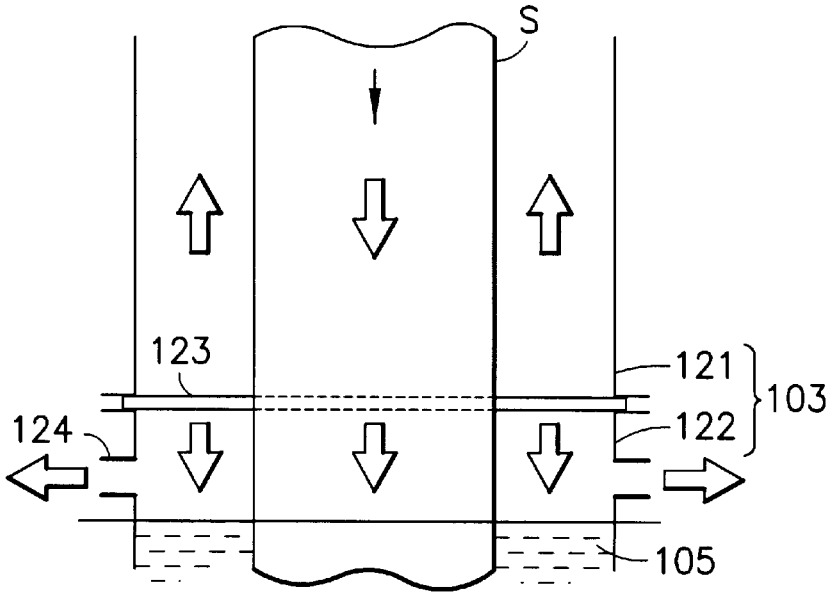

In contrast, if there is provided the sealing device and the exhausting port, the gas, as seen in FIG. 8*b*, flows in the same as in FIG. 7*b* at the side of the upstream member 121 of the sealing device 123, but the gas flows downstream at the side of the downstream member 122 of the sealing device 122, that is, between the sealing device 123 and the coating bath 105, and is discharged outside of the snout from the exhaust port 124.

In this case, the vapor of the evaporated molten metal from the coating bath 105 is rapidly discharged outside of the snout from the exhausting port 124, and is not carried to the side of the upstream member 121 over the sealing device 123. Therefore, the ashes are not created in the member 121 of the snout, an annealing furnace or the cooling furnace 101. The annealing furnace is arranged more upstream, which is not shown in FIG. 6. Accordingly, cleanings therefor are no longer necessary, and the formation of the ashes in the member 122 of the snout may be largely decreased, so that the occurrence of the product defects caused thereby may be prevented.

For effecting the gas flowing as shown in FIG. 8*b*, it is necessary to provide the exhausting ports in the vicinity of both edges in width of the steel strip so as to discharge the gas therefrom. If the exhausting ports are formed more nearly to the outsides than the edges in width of the steel strip, said effect is more heightened.

If the exhausting port is not positioned in the vicinity of both edges in width of the steel strip, said effect cannot be provided, since the gas does not flow as shown in FIG. 8*b*, so that the vapor of the molten metal evaporated from the coating bath 105 is not rapidly wasted outside of the snout.

In the apparatus shown in FIG. 6, the exhausting ports are provided two in total at both edges of the member 122 due to the operationability near to the coating bath and in relation with other facilities, but the exhausting port may be provided near to one side facing the inside and outside of the steel strip or near to both edges thereof. In this case, the exhaust port is preferably provided outside than the edges in width of the strip.

The gas pressure between the coating bath 105 and the sealing device 123 is decreased from that of the upstream side of the sealing device 123, so that the gas around the sealing device is made to flow from the upstream to the downstream of the sealing device, while the flowing rate is made 1 m/sec. or more, whereby said flowing is stabilized, and the gas within the snout may be smoothly discharged from the exhausting port 124 formed in the member 122 at the lower part of the sealing device.

However, if the gas flowing rate exceeds 3 m/sec., an amount of the gas passing the sealing device 123 is too much and there occurs a problem in the operationability, increasing of the gas amount or controlling of pressure of the furnace. Thus, an upper limit of the gas flowing is set to be not more than 3 m/sec., more preferably not more than 2 m/sec.

The gas flowing rate V can almost be calculated from the following formula, if gas pressures within the facility to be detected by the pressure gauges 134, 135 equipped at the downstream side are P1 and P2, $$V=k\cdot(P1-P2)^{1/2}$$

herein, k is a coefficient determined by gas composition, temperature, size of the opening portion of the sealing device and line steed.

If the gas pressure between the coating bath 105 and the sealing device 123 is increased to be greater than that of the outside of the facility, air is prevented from invasion into the facility from the outside.

If the amount of discharging of the gas is adjusted by a valve 130 on the pipe 125, the gas flowing rate may be predetermined at the sealing portion, while the gas pressure between the coating bath 105 and the sealing device 123 may be heigher than that of the outside of the facility.

Since the metal vapor is contained in the waste gas, it condenses within the pipe and adheres as ashes to the interior thereof. When much ashes are absorbed thereto, the pipe is clogged to diminish appropriate gas discharging. For preventing this, the ashes in the pipe must be removed.

There has conventionally been a method for removing the ashes by blowing the gas at high speed in a direction of discharging the waste gas, but this is not efficient. In the apparatus shown in FIG. 6, for removing the ashes from the pipe, nitrogen gas is blown at high speed in an opposite direction to the flowing of the waste gas. The nitrogen gas of the high speed is blown in the pipe 128 as shown with an open arrow in FIG. 6 and flows within the pipe 126 in the opposite direction to the ordinary flowing of the waste gas and is discharged at the pipe 129.

Figure 9A:
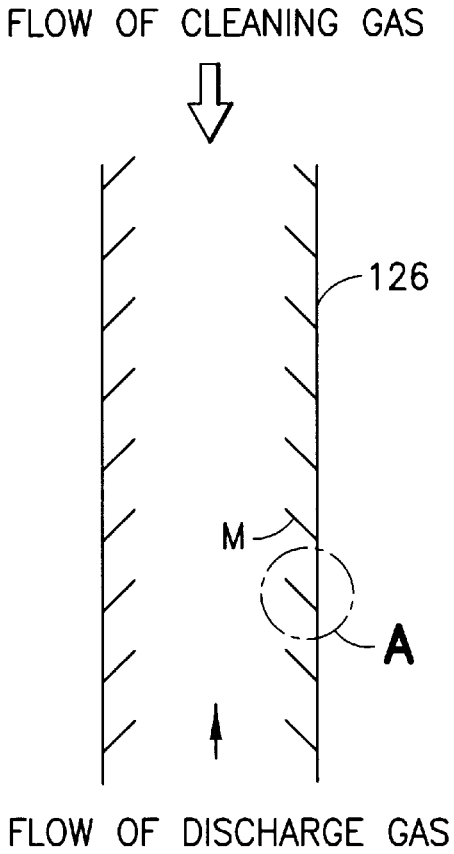
FIG. 9*a* and FIG. 9*b* are views showing ashes adhering to the interior of the pipe.
Figure 9B:
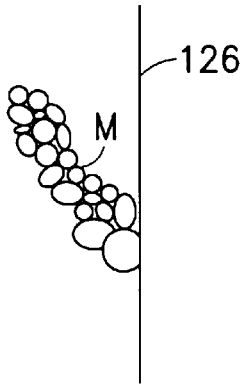

The ashes M are, normally as shown in FIG. 9*a* and FIG. 9*b*, solidified and, adhered to the interior of the pipe 126 and the ashes glow in the direction of the waste gas. In the apparatus shown in FIG. 6, the nitrogen gas is blown at the high speed in the opposite direction of said solidification, thereby enabling to efficiently remove almost all ashes from the pipe 126. The ashes discharged from the pipe 129 are not shown, but collected in an ash collecting device. In the apparatus shown in FIG. 6, the nitrogen gas is used as the high speed gas, but air may be employed therefor.

The coating is carried out as follows by means of the present apparatus. After annealing in a not shown annealing furnace, the steel strip S cooled to a predetermined temperature in the cooling furnace 101 passes the snout 103, goes into the coating pot 104, turns at the sink roll 106, gets out from the coating pot 104, enters a gas wiping nozzle 107 to have a predetermined coating amount, and advances to a subsequent process. During the coating operation, valves 130, 131 are opened, while valves 132, 133 are closed.

An atmospheric gas is supplied into the facility from the not shown annealing furnace and the cooling furnace 101, and flows toward an inlet of the facility in an opposite direction to the strip running direction. A part of the atmospheric gas passes the sealing device 123, flows to the member 122 at the lower part of the snout, and gets out of the facility through the pipes 125, 126, 127 from the exhausting port 124. An opening angle of the valve 130 is adjusted as required such that the gas pressure is increased to be greater than that of the outside of the facility, and the gas flowing rate from the upstream side of the sealing device to the coating bath is set to be 1 m/sec or more.

Coating machinery such as the sink roll, the gas wiping nozzle and other machinery is periodically exchanged by stopping the coating line. While the line stops, the ashes are removed from the interior of the pipe 26 by closing the valves 130, 131 and opening the valves 132, 133, blowing the nitrogen gas at the high speed from the pipe 128 into the pipe 126 to remove the ashes, and taking them out.

Figure 10:
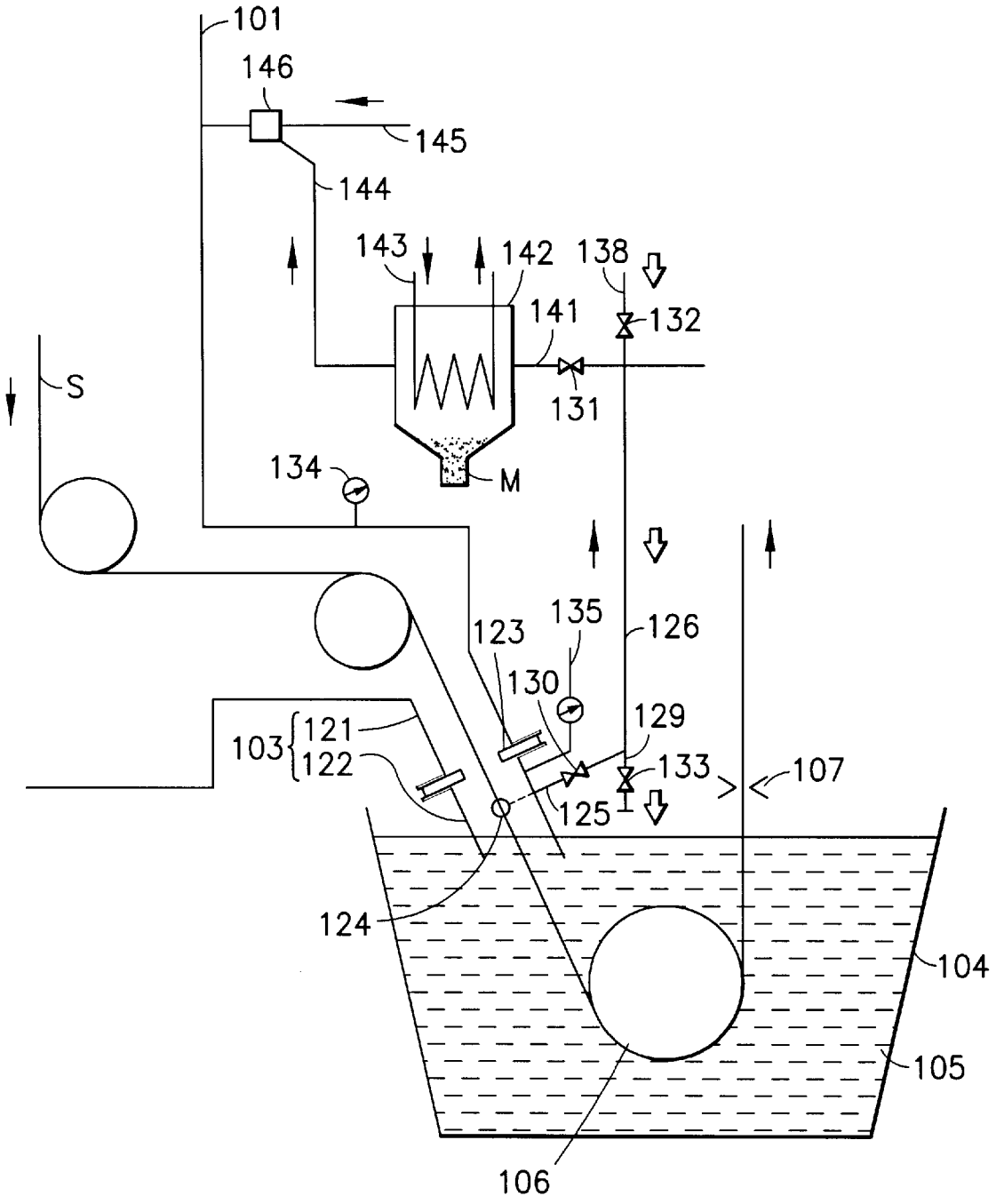
FIG. 10 is a schematic view showing the coating apparatus according to the Embodiment 2.

Another embodiment of the present invention will be explained with reference to FIG. 10 showing a schematic view of the coating apparatus.

Since the metal vapor is included in the waste gas, when the waste gas goes to a lower temperature, it becomes metal powder (ash). The ash must be removed by a filter, cyclone and others. In the apparatus of FIG. 10, in addition to FIG. 6, there is disposed an ash yielding device having a cooling apparatus in a part of the pipes so as to collect and remove the ashes and return a gas after ash removal into the cooling furnace 101. In FIG. 10, numeral 142 designates an ash recovery device, 143 is a cooling device, 145 is a nitrogen gas supplying pipe and 146 is an ejector.

The nitrogen gas is supplied into the cooling furnace 101 via the ejector 146 from the pipe 145. By actuation of the ejector 146, the gas within the facility is exhausted from exhausting port 124, passes the pipes 125, 126, 141, is cooled by the cooling device 143 in the ash recovery device 142, and the metal vapor is yielded as ashes M and removed. The gas for removing the ashes passes the pipe 144 and the ejector 146, and returns to the cooling furnace 101. Thus, as the atmospheric gas is circulated for using, the amount of the use of the atmospheric gas may be decreased.

The ashes caught in the pipes on the way of the ash recovery device 142 can be removed by blowing the nitrogen gas of high speed from the pipe 128 in the same manner as shown in FIG. 6.

By the gas removing effect, ash cleaning operations taking 112 hours at a time in two weeks are no longer required, and productivity goes up 4.6%, and there is no product defects caused by the above mentioned inconveniences.

Depending upon the present invention, the following effects may be brought about.

(1) Since the metal vapor within the snout can be rapidly exhausted outside of the facility, generation of the ash therewithin is largely decreased, so that the product defects caused thereby may be prevented.

(2) Since the ashes are not generated in the annealing furnace and the cooling furnace, the cleaning operations are unnecessary, and the productivity can be heightened.

(3) Transferring of the molten metal does not depend upon pumping, so that there is no problem about durability of the device and apparatus.

If the present invention is applied to productions of coated steel strips of molten Al—Zn alloy, called as galvalium containing 55 wt. % Al, steel strips of high quality may be produced.

Embodiment 3

To prevent quality defects caused from oxide and deposit (hereinafter referred to simply as "ash") formed by evaporation of molten metal in a zinc molten metal coating process, discharge of the metal vapor to outside of the apparatus is an effective means. The discharge of metal vapor should be carried out by a means other than mechanical means. From the point of work environment, the metal vapor contained in the discharged gas is necessary to be removed. So the method for recovering the metal vapor was also investigated.

The present invention was derived from the result of investigation based on the above-described concept. The conformation of the present invention is characterized in the following.

A continuous coating method of zinc molten metal comprises the step of continuously passing a steel strip through a zinc molten metal coating bath containing molten zinc or molten zinc/aluminum alloy, wherein a gas containing a metal vapor is introduced to an ash recovery section from an exhaust opening located at a snout while maintaining the temperature of the gas to above the melting point of zinc, which exhaust opening functions to discharge the gas to prevent the metal vapor generated from the surface of the molten metal in the snout from entering a preceding stage, and wherein the metal vapor contained in the gas is collected in a form of ash to remove from the gas by cooling thus introduced gas to or below the melting point of zinc in the ash recovery section, then the gas which eliminated the metal vapor therefrom is vented to barometric air from the tank via a vent pipe.

The metal vapor evaporated from the surface of the molten metal bath containing zinc or zinc/aluminum alloy is promptly discharged from an exhaust opening on the snout to outside of the apparatus. The gas discharged from the exhaust opening is introduced to the succeeding ash collection section (ash collection tank) at a temperature above the melting point of zinc. Accordingly, the metal vapor does not become ash before entering the ash collection section. In the ash collection to or below the melting point of zinc to generate ash. The generated ash is collected and removed in the tank and does not return to the snout.

Therefore, the amount of generated ash from the metal vapor in the snout and in the furnace is significantly decreased, and the quality defects caused from the ash is prevented.

The metal vapor contained in the gas is collected and removed in the tank in a form of ash, so the ash is not vented to external barometric air.

The exhaust opening is located at 2 meter or less above the surface of molten metal bath, and the gas is vented to external barometric air by a pressure difference between the internal pressure of furnace and the external barometric air pressure and by a draft between the exhaust opening and the front end of the vent pipe. At the same time, a means to regulate the gas flow rate located in the course of the vent pipe controls the flow rate of venting gas. That is, the gas is discharged using a draft which is a natural means, not using a mechanical means. Accordingly, the problem of sucking external air into the furnace is surely prevented.

The present invention is described in more detail in the following referring to embodiment.

Figure 11:
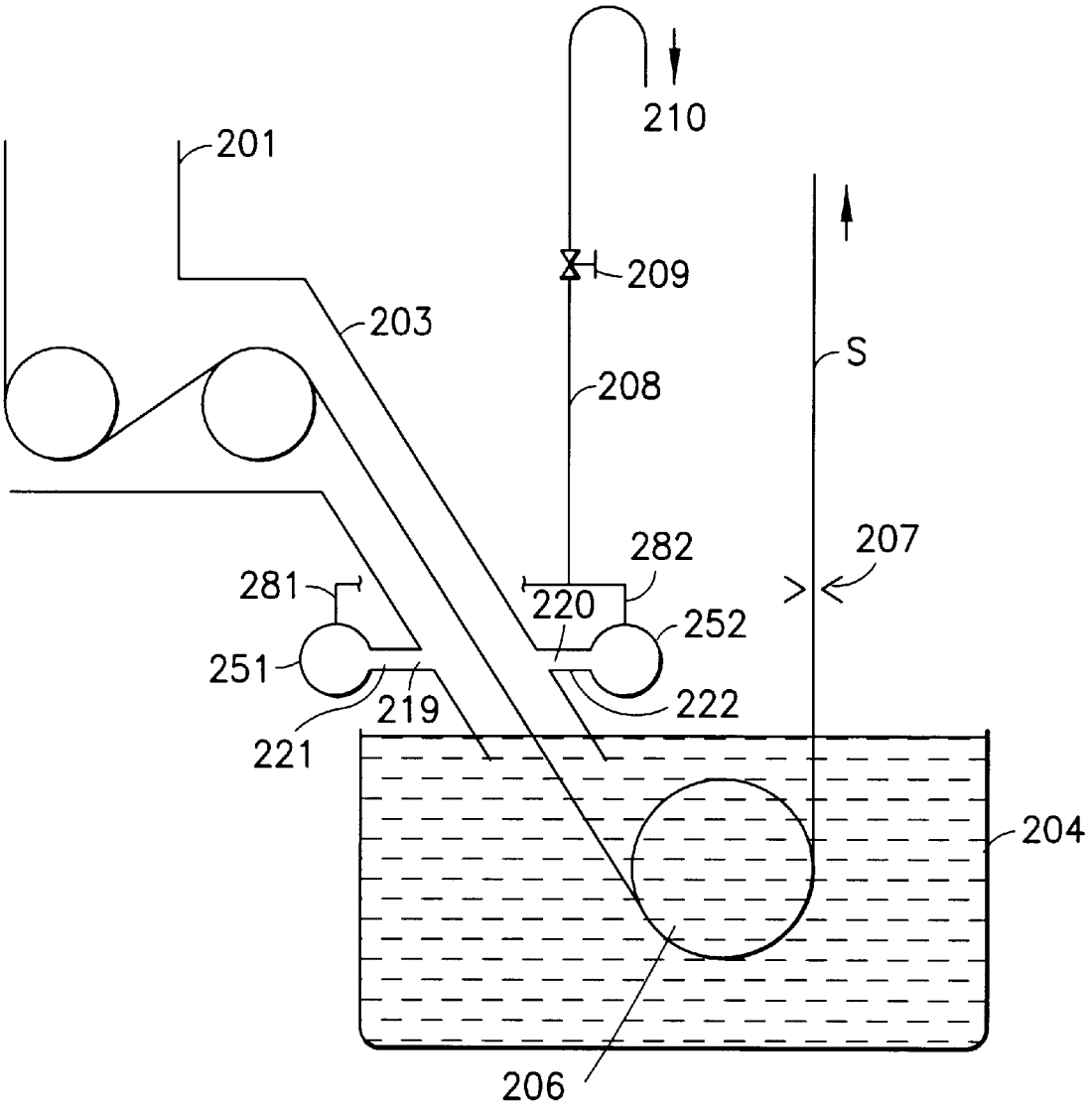
FIG. 11 is a cross sectional view showing a coating apparatus according to the Embodiment 3.

FIG. 11 shows a schematic drawing of a cross section of coating apparatus to explain an example according to the present invention.

Figure 12:
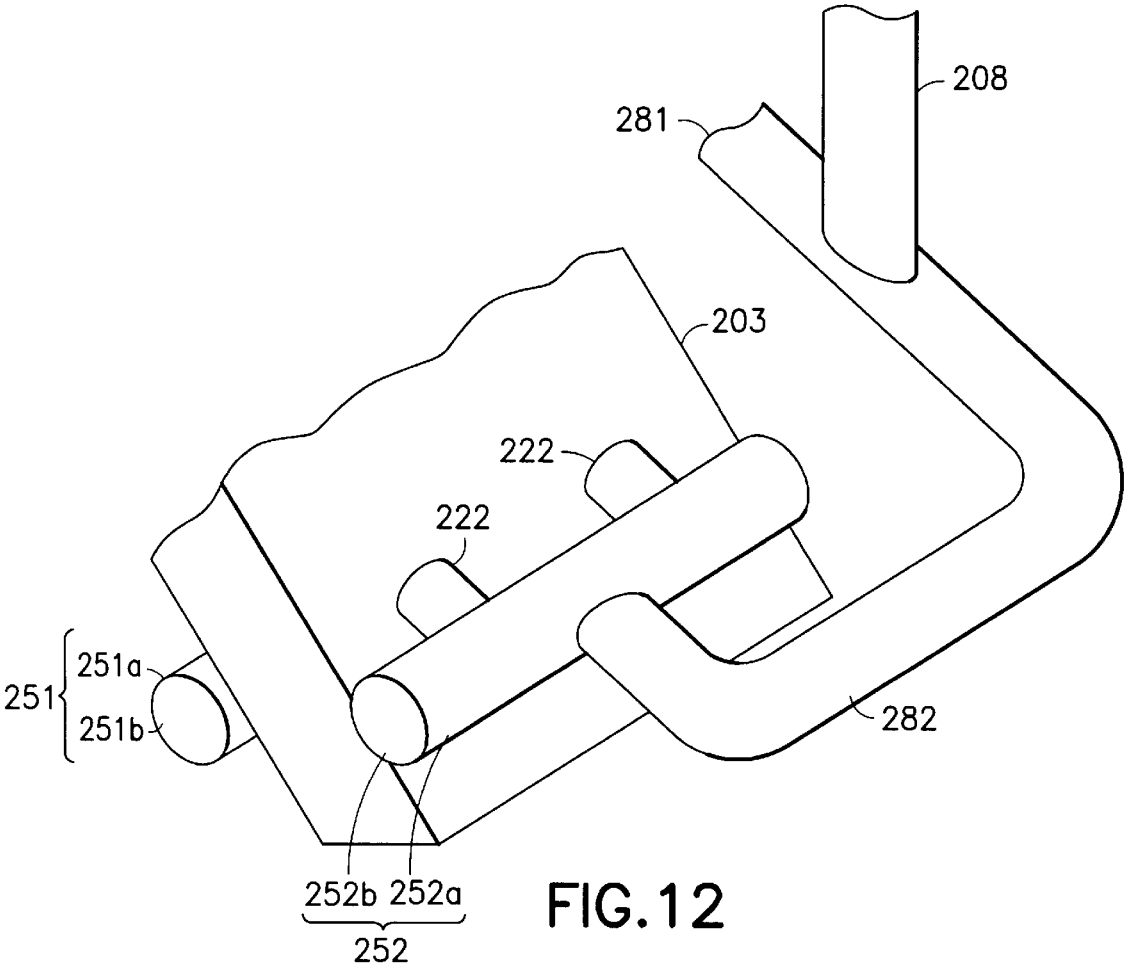
FIG. 12 is a perspective view showing major portions of piping that discharges gas in the apparatus shown in FIG. 11.

FIG. 12 shows a part of piping that discharges the gas from the apparatus shown in FIG. 11. In FIGS. 11 and 12, the symbol 201 denotes a cooling furnace, 203 denotes a snout, 204 denotes coating bath, 206 denotes sink a roll, 207 denotes a gas wiping nozzle, 219 and 220 denote exhaust openings, 221, 222, 281, and 282 denote exhaust pipes, 251 and 252 denote ash collection tanks, and 8 denotes a vent pipe.

The number of the gas exhaust openings 219, 220 located at the snout 203 is four: two in the width direction of the steel strip at a spacing of 1800 mm, and two at an opposite facing place on the front and the rear face of the steel strip; all of which are located at 1 meter above the operating surface of the molten metal. The reason why the exhaust openings 219, 220 are located at distant places in the width direction on the front and rear faces is that a numerical analysis and a wind tunnel experiment found that it is effective to discharge the gas containing metal vapor from both edges in the width direction of the steel strip in the snout 203 for efficient discharge of the gas containing metal vapor from the snout 203.

An experiment confirmed that the gas discharge efficiency increases when the exhaust opening is in a slit shape along the width direction of the steel strip. Nevertheless, the apparatus of FIG. 11 adopted the shape of the exhaust openings 219 and 220 in a circular shape same as the cross section of the exhaust pipes 221 and 222 because the same shape between the exhaust opening and the exhaust pipes 221, 222 reduces mechanical restriction and eases the connection thereeach.

To prevent the metal vapor contained in the discharged gas from solidifying to generate ash in the exhaust pipes 221, 222, the discharged gas in the pipes is necessary to be maintained to a level above the melting point of zinc. When the temperature of discharged gas is high, the exhaust pipes 221, 222 may be ordinary ones. If, however, the temperature of discharged gas is low as in the case of molten zinc coating, the temperature of the inside wall surface of the exhaust pipes 221, 222 becomes to or below the melting point of zinc, and the temperature of the gas in the vicinity of the inside wall surface becomes to or below the melting point of zinc to generate ash, which ash may then return to the snout. In that case, it is necessary to fabricate the exhaust pipes 221, 222 with heat-insulated pipes or heating pipes to maintain the inner wall surface temperature to above the melting point of zinc to avoid the gas temperature becoming to or below the melting point of zinc.

The exhaust pipes 221, 22 have a structure difficult for cleaning. By bringing the gas temperature in the exhaust gas pipes 221, 222 to above the melting point of zinc, the ash generation in the pipe section is prevented, thus eliminating the necessity of pipe cleaning. When the exhaust pipes 221, 222 are laid almost horizontally or downward from the exhaust openings 219, 220, respectively, then, even if a slight amount of ash is formed during the start up period, the ash is prevented from entering the snout, thus that type of piping method is more favorable.

According to the apparatus shown in FIG. 11, the exhaust pipes 221, 222 are made of insulated pipes to keep the gas temperature at or above 420° C. by maintaining the temperature of inner wall surface of the pipes to above 420° C. which is above the melting point of zinc, and the pipes have an inner diameter of 100 mm, and being laid horizontally.

As shown in FIG. 12, the exhaust pipes 221, 222 are arranged each two of them in the width direction of the steel strip S in the snout facing front side and rear side thereof. The exhaust pipes 221, 222 located in the width direction of the steel strip are connected with the ash collection tanks 251, 252, respectively. The ash collection tanks 251, 252 comprise the pipes 251*a*, 252*a*, having an inner diameter of 250 mm, and side plates 251*b*, 252*b*, which are detachably attached to both ends of the pipes 251*a*, 252*a*.

The ash collection tanks 251, 252 do not have an insulation property and are in a natural cooling state so that the gas in the ash collection tanks 251, 252 reduces its temperature to about 300° C.

Consequently, the metal vapor contained in the gas solidifies to become ash. Periodic cleaning of the ash collection tanks 251, 252 makes the apparatus possible to keep in an optimum operating condition. What is emphasized is the design of a system that restricts the zone of ash generation. The apparatus shown in FIG. 11 allows to generate ash at a specific place (ash tanks 251, 252) where the gases discharged from the exhaust openings join together.

The gas after eliminating metal vapor as ash passes through the ash collection tanks 251, 252, the exhaust pipes 281, 282, respectively, and joins in the vent pipe 208, then is vented to external barometric air 210.

When the flow rate of discharged gas is excessive, the control of internal pressure of the furnace becomes impossible, and the external air may be sucked into the furnace. So a gas flow rate optimum to the apparatus is necessary to be selected. In the apparatus shown in FIG. 11 the exhaust gas flow rate was adjusted to a range of from 50 to 300 $m^3$/hour in a standard state using a valve 209 installed in the course of vent pipe 208.

According to the apparatus shown in FIG. 11, the gas is vented to external barometric air using a pressure difference between the internal pressure of furnace and the external barometric air, and using a draft between the exhaust opening and the front end of the vent pipe. At the same time, the valve 209 located in the course of the vent pipe controls the discharging gas flow rate. As a result, no external air is sucked into the furnace.

The valve 209 may be located on each of the pipes 281, 282 at the outlet of the ash collection tanks 251, 252. At such a place, however, the gas temperature is high so that there is a possibility of ash plugging to inhibit the flow rate regulation. Therefore, the place was not adopted for the valve installation.

The apparatus shown in FIG. 11 has an approximate length of meters for the vent pipe 208. Accordingly, the gas temperature was 100° C. or below at the place of the valve, and very little ash was present. There occurred no specific problem in terms of flow rate regulation.

The pipe diameter for discharging the gas from the snout and the pipe diameter in the ash collection tank for joining the discharged gas to convert the metal vapor to ash are defined by the retention time of discharged gas. Accordingly, the pipe diameter is determined after setting the gas discharge flow rate while taking into account of the necessary retention time. A test with a commercial apparatus confirmed that the time to convert the metal vapor in the gas into ash is 0.5 second or more.

The apparatus shown in FIG. 11 was designed to discharge the gas of 440° C. at a rate of 400 $m^3$/hour. That is, the flow rate of gas discharged from a single discharge opening through each of the exhaust pipes 221, 222 is 100 $m^3$/hour. The pipes 251*a*, 252*a* having an inner diameter of 250 mm and a net length of 400 mm thereeach were selected for the ash tanks 251, 252, and thus secured the average retention time of 0.7 seconds.

The deposited ash in the ash collection tanks 251, 252 is necessary to be periodically removed. According to the apparatus, it is possible to remove the ash inside of the ash collection tank by sucking it within a period of replacement of the sink roll by removing the side plates 251*b*, 252*b* on both sides of the ash collection tanks 251, 252, at a time to replace the sink roll.

A coating is carried out using the apparatus shown in FIG. 11 following the procedure given below. A steel strip S is annealed in an annealing furnace (not shown), and is cooled in the cooling zone furnace 201 to undergo a specified heat treatment. Then the steel trip S passes through the snout 203 to enter the coating bath 204. The steel strip S taken out from the coating bath 204 is adjusted to a specified coating thickness by the gas wiping nozzle 207, and is cooled before entering the succeeding step.

The atmospheric gas is supplied from the annealing furnace (not shown) or from the cooling furnace 201 to the apparatus. The atmospheric gas flows toward the inlet of the apparatus inverse to the running direction of the steel strip S. A part of the atmospheric gas is discharged from the exhaust openings 219, 220 along with the metal vapor. The metal vapor is collected and removed as ash in the ash collection tanks 251, 252, then the atmospheric gas is vented to external barometric air via the vent pipe 208. During the venting a step, the opening of valve 209 is adjusted to maintain a specified discharge gas flow rate.

The coating carried out in the apparatus shown in FIG. 11 decreased the quality defects caused from ash generated from metal vapor in the snout, and the production of high quality steel plate coated by zinc molten metal was performed. Ash generation observed in the furnace in the conventional operation vanished, and no periodical cleaning is necessary. In addition, since gas containing very little ash is vented to external barometric air, the work environment has been improved.

Figure 13:
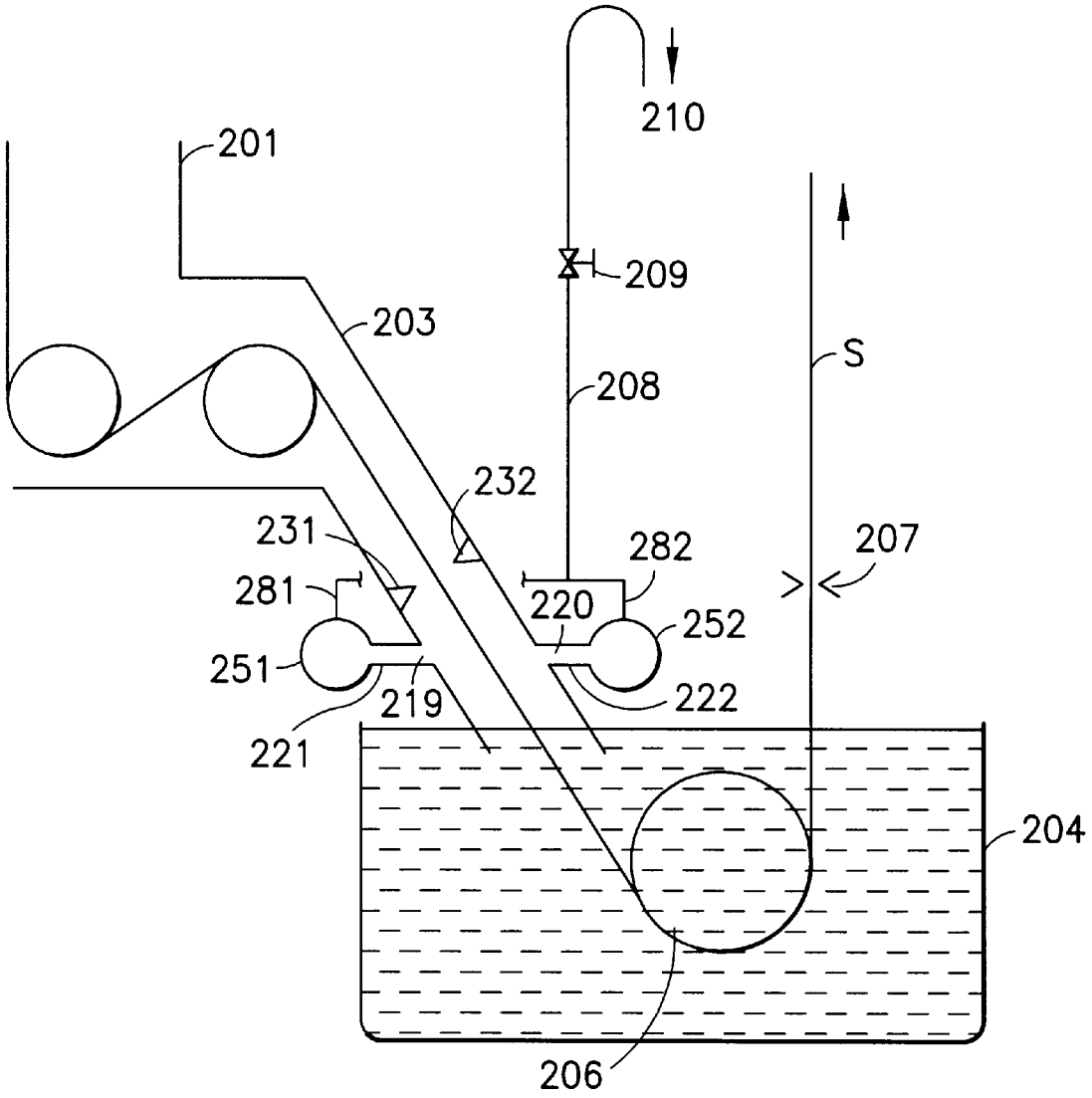
FIG. 13 is a cross sectional view showing a coating apparatus according to the Embodiment 3.

FIG. 13 shows a cross sectional view of the coating apparatus explaining another example according to the present invention. The apparatus locates the seal devices 231, 232 at above the exhaust openings aiming to surely discharge the metal vapor from the snout and to decrease the flow rate of discharging gas. Other devices are in the same arrangement with that for the apparatus of FIG. 11. Installation of the seal devices 231, 232 further decreased the discharge gas flow rate by 50%.

According to the present invention, the following effects are attained.

(1) Quality defects caused from ash generated from metal vapor in the snout are decreased. As a result, high quality steel plates coated with zinc molten metal are produced.

(2) Since ash is vanished, conventional periodic cleaning is not necessary, and the productivity is improved.

(3) Since no ash is diffused to external barometric air, the work environment is improved.

(4) Since the gas is discharged by draft, no problem of sucking external air occurs.

What is claimed is:

1. A method for hot-dip coating a steel strip comprising:

(a) continuously annealing the steel strip in an annealing furnace containing a gas, the annealing furnace having an entrance side and an exit side;

(b) introducing the annealed steel strip from step (a) through a snout into a molten metal coating bath, the snout having one being connected to the annealing furnace and an opposite end being immersed in the molten metal coating bath;

(c) dipping the annealed steel strip into the molten metal coating bath;

(d) providing a seal device for sealing between the annealing furnace and the snout, the seal device being disposed at a deflector roll section located at the exit side of the annealing furnace;

(e) maintaining a pressure inside of the snout by adjusting the sealing device so that the pressure is a barometric pressure or more and lower by 5 $mmH_2O$ or more than the internal pressure of the annealing furnace; and (f) discharging a gas containing a metal vapor from the snout to outside of the snout, the metal vapor being evaporated from the molten metal coating bath in the snout.

2. The method of claim 1, further comprising a deflector roll for moving the steel strip from the furnace through the snout and into the molten metal coating bath, the deflector roll being disposed at the end of the snout which is connected to the furnace; the sealing device comprising a top seal which protrudes from the snout to the deflector roll, so that the distance between the top seal and the deflector roll is 10 to 40 mm and a bottom seal which protrudes from the snout to the deflector roll, so that the distance between the bottom seal and the deflector roll is 5 to 10 mm.

3. The method of claim 1, wherein the pressure inside of the snout is lower by 5–10 $mmH_2O$ than the internal pressure of the annealing furnace.

4. The method of claim 1, further comprising the steps of:

removing the metal vapor from gas discharged from the snout to clean the discharged gas; and returning the cleaned gas into the annealing furnace.

5. A method for hot-dip coating a steel strip comprising:

(a) continuously annealing the steel strip in an annealing furnace;

(b) introducing the annealed steel strip from step (a) through a snout into a molten metal coating bath, the snout having one end being connected to the annealing furnace and an opposite end being immersed in the molten metal coating bath;

(c) dipping the annealed steel strip into the molten metal coating bath;

(d) sealing the molten metal coating bath from the annealing furnace by a seal device having a seal portion disposed inside of the snout; (e) providing pipes having exhaust ports which are disposed adjacent to both edges of the width of the steel strip, at the snout; and (f) discharging-a gas containing a metal vapor in the snout between the sealing device and the molten metal coating bath through the pipes having the exhaust ports.

6. The method of claim 5, wherein the molten metal coating bath is a molten Al—Zn alloy coating bath.

7. The method of claim 5, wherein the step so that the gas flows at a rate of 1 m/sec. or more from the annealing furnace to the molten metal coating bath; and maintaining a gas pressure in the snout between the coating bath and the sealing device to be higher than the pressure outside of the snout.

8. The method of claim 5, further comprising the steps of:

removing the metal vapor from the gas discharged from the snout to clean the discharged gas; and returning the cleaned gas into the annealing furnace.

9. The method of claim 5, further comprising the steps of blowing a gas into the pipes to remove metal powders adhered to an inner surface of the pipes.

10. A method for hot-dip coating a steel strip comprising:

(a) continuously annealing the steel strip in an annealing furnace;

(b) introducing the annealed steel strip from step (a) through a snout into a molten metal coating bath, the snout having one end being connected to the annealing furnace and an opposite end being immersed in the molten metal coating bath;

(c) dipping the annealed steel strip into the molten metal coating bath;

(d) providing pipes having exhaust ports which are disposed adjacent to both edges of the width of the steel strip, at the snout;

(e) discharging a gas containing a metal vapor generated from the molten metal coating bath in the snout through the exhaust ports disposed in the snout to prevent the metal vapor from entering the annealing furnace;

(f) introducing the discharged gas from step (e) into an ash recovery tank while maintaining a temperature of the discharged gas to a melting point of zinc or more;

(g) cooling the introduced gas from step (f) below the melting point of zinc in the ash recovery tank to convert the metal vapor to ash and remove the ash from the gas; and (h) venting the gas from the ash recovery tank from step (g) through a vent pipe to the atmosphere.

11. The method of claim 10, wherein the exhaust ports are arranged at 2 meters or less above a surface of the molten metal coating bath.

12. The method of claim 10, further comprising the step of controlling a flow rate of the vented gas through the vent pipe.

* * * * *